US007658373B2

(12) United States Patent
Jufer

(10) Patent No.: US 7,658,373 B2
(45) Date of Patent: Feb. 9, 2010

(54) METHOD FOR PRODUCING MULTI-PART PRINT PRODUCTS

(75) Inventor: Walter Jufer, Oftringen (CH)

(73) Assignee: Müller Martini Holding AG, Hergiswil (CH)

( * ) Notice: Subject to any disclaimer, the term of this patent is extended or adjusted under 35 U.S.C. 154(b) by 57 days.

(21) Appl. No.: 11/403,911

(22) Filed: Apr. 14, 2006

(65) Prior Publication Data

US 2006/0235363 A1 Oct. 19, 2006

(30) Foreign Application Priority Data

Apr. 14, 2005 (EP) ..... 05405294

(51) Int. Cl.
*B65H 5/30* (2006.01)

(52) U.S. Cl. ..... 270/52.25; 270/52.14; 270/52.16; 270/52.19; 270/52.2; 270/52.21; 270/52.22; 270/52.23

(58) Field of Classification Search ..... 270/52.14, 270/52.16, 52.19, 52.2, 52.21, 52.22, 52.23, 270/52.25
See application file for complete search history.

(56) References Cited

U.S. PATENT DOCUMENTS 4,046,367 A 9/1977 Merker et al.
6,234,466 B1 * 5/2001 Infanger ..... 270/52.23
6,311,968 B1 * 11/2001 Linder et al. ..... 270/52.25

FOREIGN PATENT DOCUMENTS

| | | | |
|---|---|---|---|
| DE | 24 47 336 | A1 | 4/1975 |
| EP | 0 554 801 | A | 8/1993 |
| EP | 0 911 289 | A1 | 4/1999 |
| EP | 1 371 501 | A | 12/2003 |

* cited by examiner

*Primary Examiner*—Gene Crawford
*Assistant Examiner*—Leslie A Nicholson, III
(74) *Attorney, Agent, or Firm*—Venable LLP; Robert Kinberg; Justine A. Gozzi

(57) ABSTRACT

A method for producing multi-part print products includes supplying a folded main print product fold first to respectively one pouch of successively following pouches on a conveying device for a production line that includes a plurality of feeders. The folded main print product has front and rear legs extending from the fold. The rear leg has a frontal edge region that is penetrable by a movable clamping part. The method further includes moving the front and rear legs apart by penetrating the frontal edge region of the rear leg with the movable clamping part to clamp the front leg against a pouch wall. At least one partial print product is inserted into the main print product when the front and rear legs are moved apart to accommodate partial print products side-by-side.

10 Claims, 3 Drawing Sheets

METHOD FOR PRODUCING MULTI-PART PRINT PRODUCTS

CROSS-REFERENCE TO RELATED APPLICATION

This application claims the priority of European Patent Application No: 05405294.9-2314, filed on Apr. 14, 2005, the subject matter of which is incorporated herein by reference together with each and every U.S. and foreign patent and patent application mentioned herein.

BACKGROUND OF THE INVENTION

The invention relates to a method for producing multi-part print products by inserting at least one partial product into at least one folded main product which accommodates the partial products side-by-side and is respectively supplied to one of the pouches which are successively arranged on a conveying device for a production line, formed with the aid of feeders, and is opened by moving apart the main product legs for inserting the partial products.

A method of this type is known from European Patent document EP 0 911 289 A, which discloses a method for producing print products by inserting partial products into a main product, previously fed into the pouch of an inserting machine. The main products and the partial products are produced, for example, with the aid of a system comprising a sliding rail, as well as a gathering and stitching machine equipped with several feeders, wherein the products are supplied in the form of an overlapping flow to the pouches. These partial products are also referred to as initial products and are normally available for processing even before the main product is produced, wherein the partial products can also be supplements, inserts, or the like. The main product can comprise, for example, the current politics section and/or the sports section. For the opening, the main product is gripped along a protruding gripping edge. However, the insertion of partial products into a main product without having a protruding gripping edge of this type is not possible with this method.

German patent document DE 24 47 336 A discloses an apparatus for processing print products, wherein at least one initial product can be inserted into a main printing product. The main products are respectively supplied to separate pouches of a cell wheel. This cell wheel is provided with a plurality of expanding wedges against which the main products are moved with a forward movement in axial direction of the cell wheel for opening the main products.

SUMMARY OF THE INVENTION

It is an object of the present invention to provide a method of the aforementioned type that allows the production of print products that are even more reader-friendly. The method is intended to combine a high capacity with a secure operation, in particular for producing reader-friendly tabloids.

The above and other objects are accomplished according to the invention wherein there is provided an exemplary embodiment of a method for producing multi-part print products, comprising: supplying a folded main print product fold first to respectively one pouch of successively following pouches on a conveying device for a production line including a plurality of feeders, the folded main print product having front and rear legs extending from the fold, the rear leg having a frontal edge region that is penetrable by a movable clamping part; moving the front and rear legs apart by penetrating the frontal edge region of the rear leg with the movable clamping part to clamp the front leg against a pouch wall; and inserting at least one partial print product into the main print product when the front and rear legs are moved apart to accommodate partial print products side-by-side.

This method according to the invention solves the above object in that for the insertion of partial products into the main product, a movable clamping part extends in a frontal edge region through a leg of the main product, intended for the opening, wherein this movable clamping part also hold the other leg of the main product and/or the partial product against a pouch wall. With the method according to the invention, main products as well as partial products can thus be arranged essentially at optional locations in the end product, thus arriving at a more reader-friendly composition of the end product. Since the clamping part extends in a frontal edge region through the spread-out leg, a protruding gripping edge is not needed. The method is therefore particularly suitable for tabloids, which are not provided with a gripping edge. By allowing the clamping part to extend through the leg in this way, the partial products can be inserted at optional locations into the main product. In addition, partial products can also be inserted into other partial products. For example, a specific insert or supplement can be inserted into a sports section and a different one into a section about politics.

According to one modification, it is particularly easy for the clamping part to extend through and/or penetrate the frontal edge region, having at least one clamping region, if the edge region has at least one recess. This recess can be produced very easily by punching, wherein the respective signatures are punched prior to inserting them into a pouch. The production capacity is not critically affected by this.

According to a different modification of the invention, a clamping part extends in a frontal edge region through at least one partial product that is inserted into the main product. Even partial products can thus be structured, for example by adding a different partial product, e.g. a supplement, to the aforementioned partial product. In principle, the supplement can be inserted at any location into the aforementioned partial product.

According to another modification of the invention, recesses are provided which can also form a register. On the one hand, respectively one gripping clamp extends through these recesses for the structuring while, on the other hand, these recesses are used to form a register and in particular a gripping register for the end product. The recesses have corresponding depths, which make it easier, for example, to find a respective insert or partial product. The recesses are preferably punched-out areas, which are open toward the front. Such punched out areas can be produced easily and quickly and preferably have rounded edges.

According to a different modification of the invention, the main product consists of at least two sections which preferably do not have gripping folds and were printed during a single printing operation. At least one partial product is inserted into this main product.

The method is particularly suitable for producing so-called tabloids, but can in principle also be used for producing so-called broad sheets. Above all, the method according to the invention can be used to structure extremely thick tabloids to considerably improve the readability. The use of such a recess, for example, makes it possible to find the sports section or the political section immediately, which has not been possible so far with extremely thick tabloids. It is furthermore also possible to remove a section, such as the sports section, easily from the tabloid.

Additional advantageous features follow from the dependent claims, the following description, as well as the drawing.

BRIEF DESCRIPTION OF THE DRAWINGS

These and other features and advantages of the invention will be further understood from the following detailed description of the preferred embodiments with reference to the accompanying drawings in which.

DETAILED DESCRIPTION OF PREFERRED EMBODIMENTS

Figure 1:
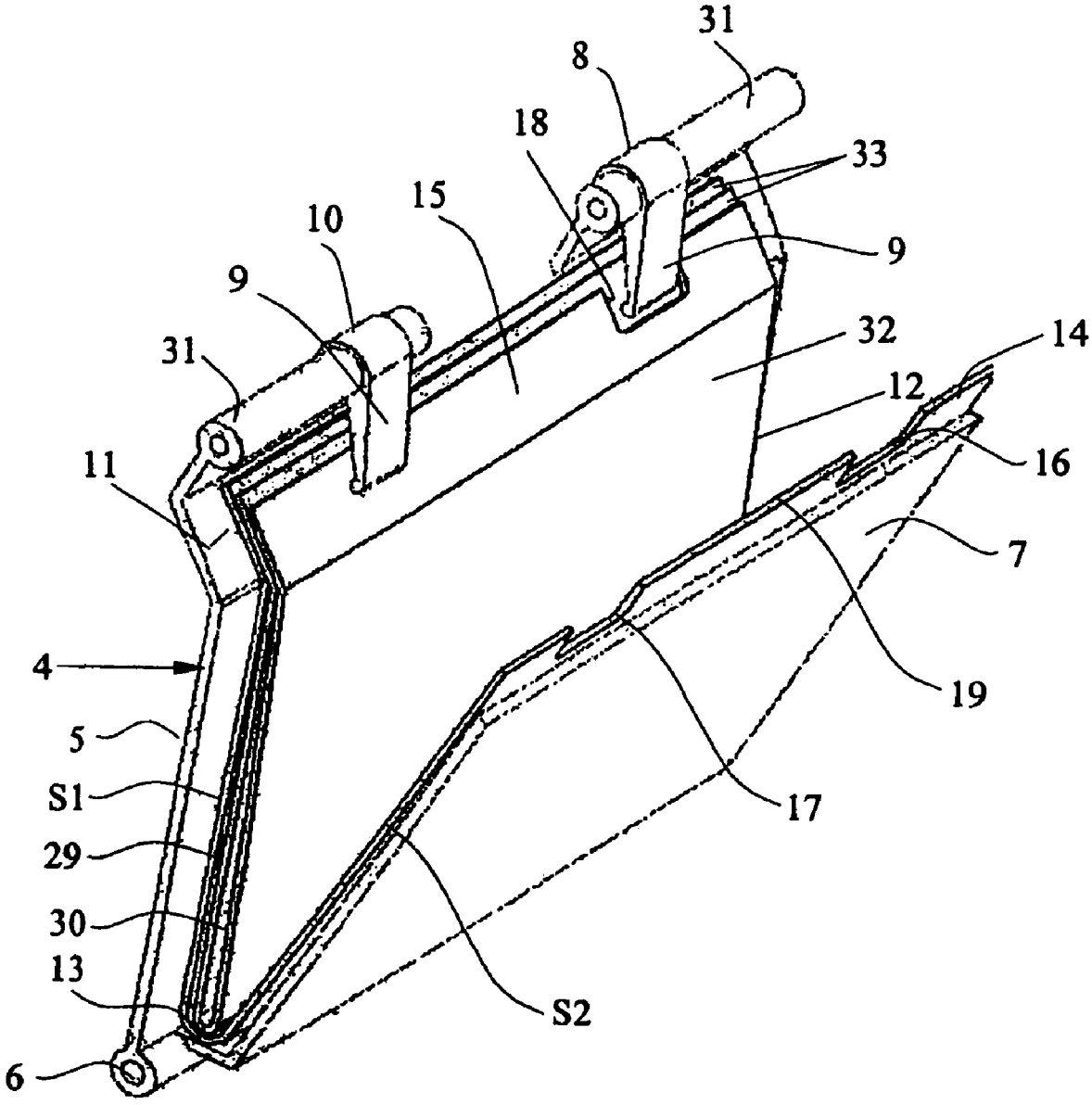
FIG. 1 Shows a schematic view of an opened pouch with inserted main product.

Referring to FIG. 1, there is shown a pouch 4 of a conveying device, which is known per se and is used in the print-processing industry. The pouch comprises a front pouch wall 5 and a rear pouch wall 7, which are connected pivoting by means of a hinge 6. The pouch 4 shown in FIG. 1 is in the open position. The pouch 4 can be closed with the aid of a control device, which is known per se but is not shown herein, for example by pivoting the rear pouch wall 7 around the hinge 6. The pouch 4 can be a single pouch, for example, on a pouch wheel used for displacing the print products parallel to the rotational axis. As illustrated in FIG. 1, the pouch 4 on the conveying device is open on the side and on the top. A main product 12 is inserted from the top into the pouch. The main product 12 has a fold 13 and a frontal edge region 15 which is parallel to the fold. One leg S1 of the main product 12 is held with the aid of clamps 8 and 10 against the front pouch wall 5. A different leg S2 rests on the inside against the rear pouch wall 7. The main product 12 can be composed of two sections 29 and 30, with the outer section 29 forming the current news section and the inner section 30 the sports section of a newspaper or magazine. The two sections 29 and 30 can be stitched or unstitched.

The two clamps 8 and 10 are respectively positioned pivoting on a support 31 on the front pouch wall 5. The pivoting movement is controlled, for example by means of a control device with suitable control curve which is not shown herein. The clamps 8 and 10 respectively include a clamping part 9 which forms an arm and is tensioned against the inside 11 of the front pouch wall 5. As can be seen, the first clamp 8 with its clamping part 9 extends through a recess 18 provided in a frontal edge region 15 of a leg part 32 on the inside section 30 and fits flush against front leg parts 33 of the leg S1 for the product. The leg S2 is provided with a corresponding recess 16 in a frontal edge region 14. This edge region 14 extends parallel to the fold 13 and is provided with an additional recess 17 at a distance to the recess 16 through which the second clamp 10 extends. The clamping part 9 of the clamp 8 extends through the recess 16. The two recesses 16 and 17 are open toward one frontal edge 19, which also extends parallel to the fold 13. According to FIG. 2, the recess 16 has two, preferably rounded corners 16*a* to prevent tearing, wherein the same also applies to the other recesses. The leg part 32 forms a part of the inside section 30 and is held against the front pouch wall 5 since a corresponding recess for the second clamp 10 is missing. The leg S2 is opened because it comprises two recesses 16 and 17 through which the clamping parts 9 of clamps 8 and 10 extend, so that the leg S2 is not gripped by the clamping parts 9 of clamps 8 and 10. If the pouch 4 with the inserted main product 12 is closed, the clamps 8 and 10 correspondingly extend through the leg S2. If the pouch 4 is opened, the leg S2 falls against the rear pouch wall 7 because it is not gripped by the clamps 8 and 10, as previously mentioned. Alternatively, the leg S2 could also be held with the aid of clamps (not shown herein) against the rear pouch wall before the pouch is opened. The opening of the main product 12 can be determined based on the different embodiments of the aforementioned recesses 16, 17, and 18. Correspondingly, it is also possible to select the location for inserting a partial product into the opened product. The main product 12 can also consist of only one section or more than two sections, which are inserted into each other, wherein this is explained in further detail in the following with the aid of FIGS. 2 to 4.

Figure 2:
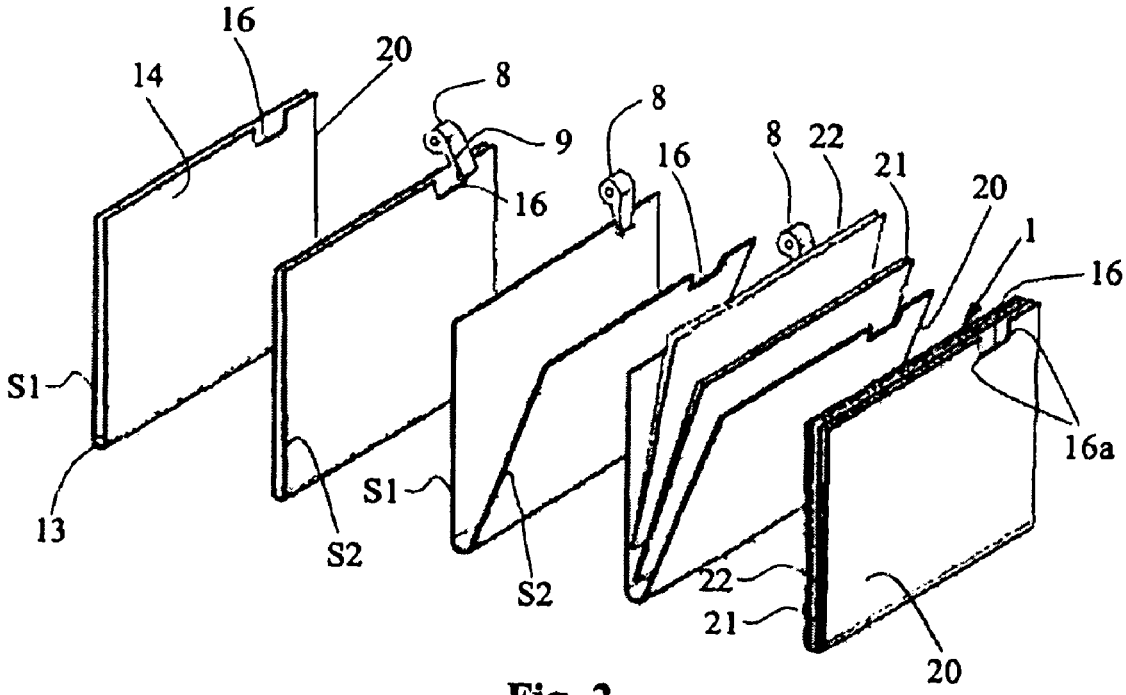
FIG. 2 Shows a three-dimensional view of different phases during the process of inserting two partial products into a main product.

A main product 20 consisting of a single section with two legs S1 and S2, which are connected by a fold 13, is shown on the far left in FIG. 2. The leg S2 has a frontal edge region 14 and a recess 16, which is open toward the top and could also be arranged at the top and/or bottom. According to FIG. 1, the two legs S1 and S2 are fitted against each other and are inserted in this way into the pouch 4, not shown herein. Following the insertion, the first clamp 8 is pivoted in while the pouch 4 is closed, as shown in the exemplary embodiment. The clamp 8 extends with the clamping part 9 through the recess 16 and thus fits flush against the leg S1. If the pouch 4 is opened, then the leg S1 is secured against the front pouch wall 5 and the leg S2 drops against the rear pouch wall 7. The main product 20 is thus opened and a first partial product 21 is initially inserted, which is then followed by a second partial product 22. The print product 1, or the final product created in this way, is therefore composed of the main product 20 and two partial products 21 and 22, inserted therein. The main product 20 in this case forms an outer section, for example of a newspaper. By pivoting the first clamp 8 upward, the print product 1 can be released and can then be removed from the pouch 4. As can be seen, the first partial product 21 is in part visible through the recess 16 and can thus be gripped easily by the reader and removed from the print product 1.

Figure 3:
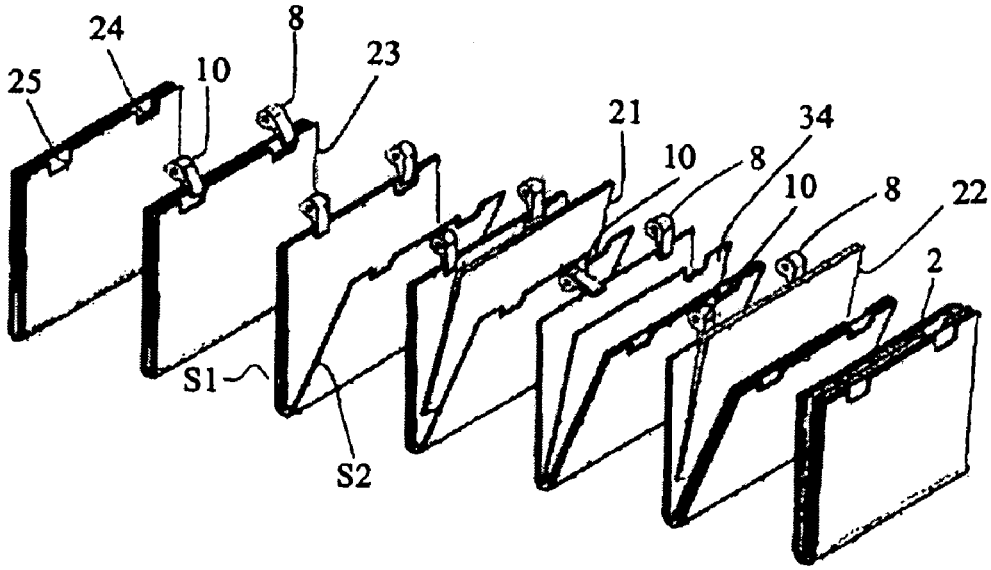
FIG. 3 Shows a variant of the method, wherein individual phases are again shown during the inserting operation.

With the exemplary embodiment shown in FIG. 3, a main product 23 is provided with two recesses 24 and 25, arranged at a distance to each other. The main product 23 consists, for example, of two sections as shown in FIG. 1. The recess 24 is visibly deeper than the recess 25. If the main product 23 is gripped by correspondingly pivoting in the two clamps 8 and 10, then the first clamp 8 grips not only the leg S1, but also at least a section of the leg S2. If both clamps 8 and 10 are closed, only a section of the leg S2 is opened. A first partial product 21 is then inserted between these leg parts. The second clamp 10 is subsequently pivoted upward, thereby exposing at least a part of the leg S2 as well as a part 34 of the leg S1, which then fall against the inserted first partial product 21 and against the rear pouch wall 7 which is not shown herein. A second partial product 22 is then inserted and comes to rest between the leg part 34 and the remaining section of the leg S1. Finally, the first clamp 8 is also pivoted upward and the print product 2, or the final product, can be removed from the pouch 4. The print product 2 contains two partial products 21 and 22 that are inserted or fitted in at predetermined locations. These locations or positions can be determined by the matching depths of the recesses 24 and 25. Of course, the main product 23 can also contain several leg parts and correspondingly different depths of the recesses 24 and 25, as explained in the following with the aid of FIG. 4.

Figure 4:
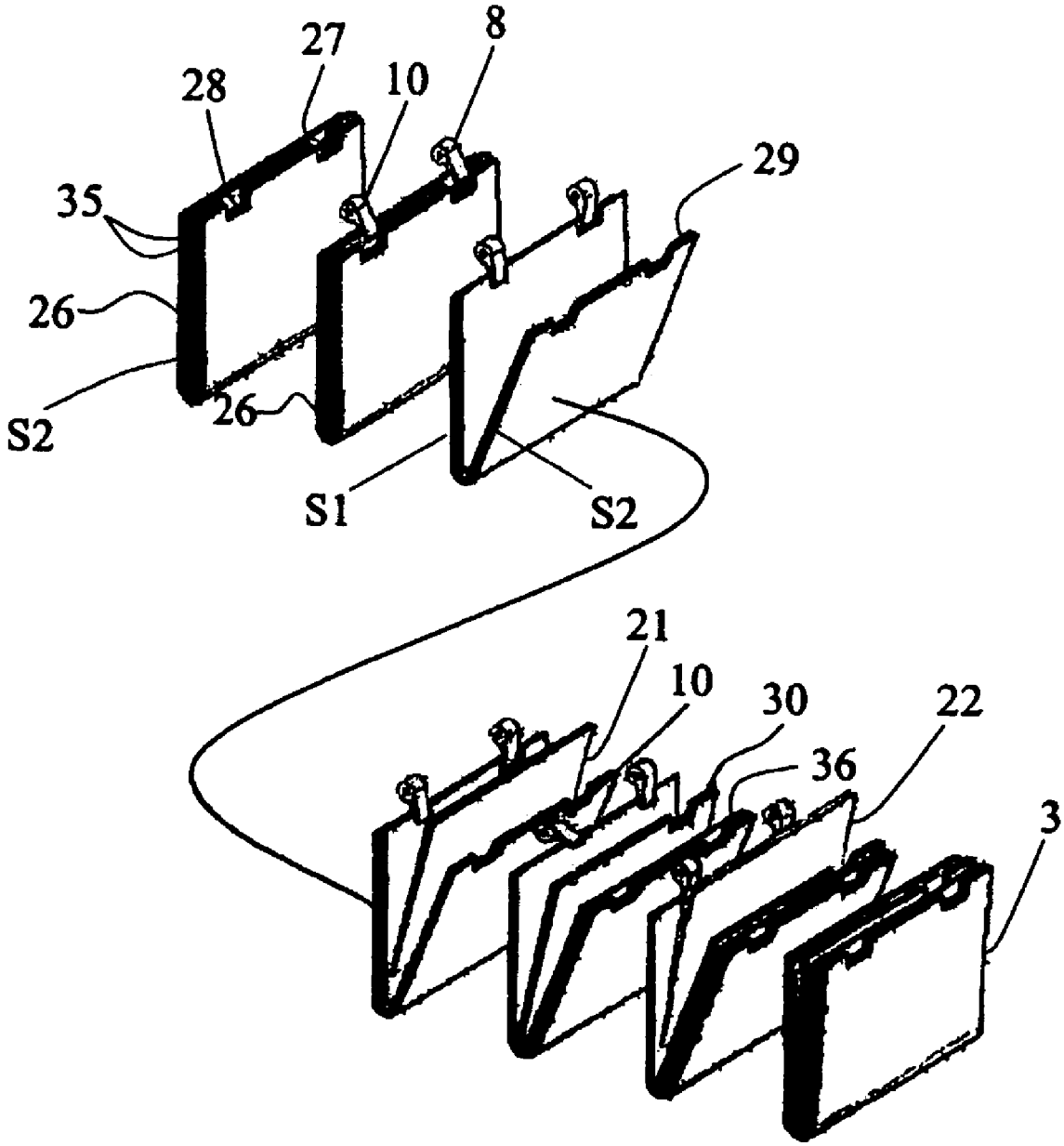
FIG. 4 Shows a different variant of the method according to the invention, wherein individual phases are illustrated.

For the method according to FIG. 4, there is shown a main product 26 for which the legs S1 and S2 respectively comprise several leg parts 35 which are provided with recesses 27 and 28. The leg parts 35 are, for example, parts of sections that are fitted into each other, wherein a section of this type can also be an initial product. If the main product 26 is gripped by the two clamps 8 and 10, the clamping parts 9 of these clamps extend through the leg parts 35 of the leg S2. As a result, the leg parts 35 of the leg S1 can be separated from the parts of the leg S2. A first partial product 21 is then inserted and positioned between the leg parts 35 of the leg S2. If the second clamp 10 is opened, then the remaining leg parts 35 of the leg S2, as well as the leg parts 36 of the leg S1, drop against the inserted first partial product 21. A second partial product 22 can then be inserted between the leg parts of the leg S1, the parts 36. Following the opening of the first clamp 8, the print product 3 can be removed from the pouch 4. The corresponding recesses on the print product 3 can thus form a type of register by means of which the corresponding sections and/or parts of the print product 3 can be found easily and quickly. In place of only two partial products 21 and 22, it is also possible to insert more than two partial and/or initial products or supplements of this type. Also, more than two recesses can be provided in place of the two spaced apart recesses 27 and 28. Correspondingly, the pouch 4 can be provided with a corresponding number of clamps.

The method consequently can be used to produce finished print products with easily accessible sections and a clear layout, for example comprising a main product with several sections and initial products as well as inserts and supplements. The main product and the initial products can be stitched individually or remain unstitched, wherein the individual sections can be removed easily from the print product. For example, if a reader of a tabloid is interested in the sports section only, the reader can easily remove only this section from the correspondingly structured tabloid. The sports section, in turn, can be provided with an insert addressed to those interested in a particular sport. This method makes possible a high output of print products which are structured in this way.

The above-described method can be realized with an arrangement, comprising a conveying device with several successively circulating pouches 4, which can be supplied with a main product 12, 20, 23, 26 and partial products 21, 22 to form the finished print products 1-3. Each pouch 4 is provided in the opening region with at least one controllable clamp 8, 10, comprising a moving clamping part 9 for holding specific print products.

The pouches 4 can be arranged in a conveying drum in order to form a cell wheel, for example an arrangement as disclosed in German patent document 24 47 336 A, in which the print products are offset along the axis of rotation for the conveying drum and are supplied with a main product as well as partial products. Even with an arrangement embodied in this way, the pouches 4 and/or the cells can be provided with several clamps, provided with movable clamping parts 9 which can be controlled independently.

It will be understood that the above description of the present invention is susceptible to various modifications, changes and adaptations, and the same are intended to be comprehended within the meaning and range of equivalents of the appended claims.

What is claimed is:

1. A method for producing multi-part print products, comprising:

supplying a folded main print product fold first to respectively one pouch of successively following pouches on a conveying device for a production line including a plurality of feeders, the folded main print product having front and rear legs extending from the fold, the rear leg having a frontal edge region that is penetrable by a movable clamping part; moving the front and rear legs apart by penetrating the frontal edge region of the rear leg with the movable clamping part to clamp the front leg against a pouch wall; and inserting at least one partial print product into the main print product when the front and rear legs are moved apart to accommodate partial print products side-by-side.

2. The method as defined in claim 1, further comprising penetrating the clamping part through a frontal edge region of a leg of the at least one partial print product after the inserting of the at least one partial print product into the main product.

3. The method as defined in claim 2, further comprising creating recesses along the frontal edge region of the legs of the print products and allowing the clamping part to penetrate the recesses.

4. The method as defined in claim 3, further comprising forming a register with the recesses and accessing different portions of the print product by the register.

5. The method as defined in claim 3, further comprising aligning the clamping parts with the recesses and distributing the recesses along the frontal edge region of the legs of at least one of the main print product and partial print products.

6. The method as defined in claim 5, wherein the main print product comprises at least two sections, and one leg of the main print product and a leg of a fed-in partial product are penetrated in the frontal edge region by the clamping part which holds in place the other leg of the main product.

7. The method as defined in claim 3, wherein the creating of recesses along the frontal edge region includes punching out areas that are open toward the frontal edge region.

8. The method as defined in claims 3, wherein the creating of recesses along the frontal edge region includes providing the recesses with rounded inside corners.

9. The method as defined in claim 3, further comprising arranging at least two clamping parts at a distance to each other and extending the two clamping parts through respective ones of at least two recesses of different depths.

10. A method for producing a tabloid, comprising utilizing the method as defined in claim 1.

* * * * *

UNITED STATES PATENT AND TRADEMARK OFFICE

CERTIFICATE OF CORRECTION

PATENT NO. : 7,658,373 B2
APPLICATION NO. : 11/403911
DATED : February 9, 2010
INVENTOR(S) : Walter Jufer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 302 days.

Signed and Sealed this

Thirtieth Day of November, 2010

David J. Kappos

David J. Kappos
*Director of the United States Patent and Trademark Office*